US009620838B2

(12) United States Patent
Nakajima et al.

(10) Patent No.: US 9,620,838 B2
(45) Date of Patent: Apr. 11, 2017

(54) NON-RECIPROCAL CIRCUIT DEVICE

(71) Applicant: Murata Manufacturing Co., Ltd., Nagaokakyo-shi, Kyoto-fu (JP)

(72) Inventors: Reiji Nakajima, Nagaokakyo (JP); Toshihiro Makino, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 133 days.

(21) Appl. No.: 14/534,423

(22) Filed: Nov. 6, 2014

(65) Prior Publication Data

US 2015/0061788 A1 Mar. 5, 2015

Related U.S. Application Data

(63) Continuation of application No. PCT/JP2013/063051, filed on May 9, 2013.

(30) Foreign Application Priority Data

May 9, 2012 (JP) ..... 2012-107530

(51) Int. Cl.
*H01P 1/383* (2006.01)
*H01P 1/387* (2006.01)

(52) U.S. Cl.
CPC ..... *H01P 1/387* (2013.01); *H01P 1/383* (2013.01)

(58) Field of Classification Search
CPC .. H01P 1/38; H01P 1/383; H01P 1/387; H01P 1/36

(Continued)

(56) References Cited

U.S. PATENT DOCUMENTS 3,818,381 A * 6/1974 Konishi ..... H01P 1/387 333/1.1
6,215,371 B1 4/2001 Kurahashi et al.
(Continued)

FOREIGN PATENT DOCUMENTS

CN 1246966 A 3/2000
JP 50-17949 A 2/1975
(Continued)

OTHER PUBLICATIONS

Translation JP10-004304.*
(Continued)

*Primary Examiner* — Stephen E Jones
(74) *Attorney, Agent, or Firm* — Keating & Bennett, LLP

(57) ABSTRACT

In a non-reciprocal circuit device, a first center conductor, a second center conductor, and a third center conductor are disposed on a ferrite, to which a direct current magnetic field is applied by a permanent magnet, so as to be insulated from one another and so as to intersect with one another. One end of the first center conductor defines a first port, one end of the second center conductor defines a second port, and one end of the third center conductor defines a third port. The first port is connected to a first terminal, the second port is connected to a second terminal, and the third port is connected to a third terminal. The other ends of the respective center conductors are connected to one another, which is connected to a ground. Capacitance elements are connected in parallel to the respective center conductors.

14 Claims, 16 Drawing Sheets

(58) Field of Classification Search
USPC ..... 333/1.1, 24.2
See application file for complete search history.

(56) References Cited

U.S. PATENT DOCUMENTS

| | | | | |
|---|---|---|---|---|
| 6,914,496 | B2 * | 7/2005 | Tanaka | H01P 1/36 333/1.1 |
| 6,943,642 | B1 * | 9/2005 | Takadate | H01P 1/387 333/1.1 |
| 2002/0079981 | A1 | 6/2002 | Tanaka | |
| 2003/0085769 | A1 | 5/2003 | Saito et al. | |

FOREIGN PATENT DOCUMENTS

| | | | |
|---|---|---|---|
| JP | 10-004304 | A | 1/1998 |
| JP | 10-284909 | A | 10/1998 |
| JP | 11-234003 | A | 8/1999 |
| JP | 2002-076711 | A | 3/2002 |
| JP | 2003-110309 | A | 4/2003 |
| JP | 2003-142903 | A | 5/2003 |
| WO | 2011/118278 | A1 | 9/2011 |

OTHER PUBLICATIONS

Official Communication issued in International Patent Application No. PCT/JP2013/063051, mailed on Aug. 6, 2013.
TDK; Non TDK Tech-Mag with ferrite; "http://www.tdk.co.jp/techmag/ferrite/grain#54/flame54.htm"; downloaded Nov. 4, 2014; 3 pages.
Official Communication issued in corresponding Chinese Patent Application No. 201380024374.0, mailed on Aug. 25, 2015.

* cited by examiner

NON-RECIPROCAL CIRCUIT DEVICE

BACKGROUND OF THE INVENTION

1. Field of the Invention

The present invention relates to non-reciprocal circuit devices, and in particular relates to a non-reciprocal circuit device, such as an isolator and a circulator, preferably for use in microwave bands, for example.

2. Description of the Related Art

To date, non-reciprocal circuit devices, such as isolators and circulators, have characteristics such that the non-reciprocal circuit devices transmit signals only in a particular direction determined in advance and do not transmit signals in the opposite direction. Utilizing such characteristics, for example, isolators are used in transmission circuit units of mobile communication devices, such as cellular phones.

A non-reciprocal circuit device described in Japanese Unexamined Patent Application Publication No. 10-284909 is known as this type of non-reciprocal circuit device that operates in a magnetic field lower than a magnetic resonant point. The non-reciprocal circuit device described in Japanese Unexamined Patent Application Publication No. 10-284909 operates in a medium magnetic field in which magnetic permeability μ+' uses a negative region. As the medium magnetic field is close to the magnetic resonant point, a magnetic loss is large, and an insertion loss thus increases. A non-reciprocal circuit device described in Non TDK Tech-Mag with ferrite (http://www.tdk.co.jp/techmag/ferrite/grain#54/flame54.htm) operates in a low magnetic field in which the magnetic permeability μ+' uses a positive region and is of a waveguide type (distributed constant type). In a waveguide type isolator, a ferrite is formed to have a size that is ½ of a frequency λ, and thus the size thereof increases in the 800 MHz band or in a several GHz band. In addition, in a low magnetic field operation, a phase difference between positive and negative circularly polarized waves is generated with small magnetic permeability, and thus a line length of approximately ½ of the frequency λ is required. Accordingly, the size of the isolator increases, and it is difficult to install such an isolator in a cellular phone or the like.

It is to be noted that, in the present specification, magnetic field regions (a high magnetic field, a medium magnetic field, and a low magnetic field) are defined as follows. A region where the magnetic field is higher than the magnetic resonant point is defined as a high magnetic field; a region where the magnetic field is lower than the magnetic resonant point and the magnetic permeability μ+' is in a negative region is defined as a medium magnetic field; and a region where the magnetic field is lower than the magnetic resonant point and the magnetic permeability μ+' is in a positive region is defined as a low magnetic field.

SUMMARY OF THE INVENTION

Preferred embodiments of the present invention provide a lumped constant type non-reciprocal circuit device that is reduced in size and suffers a lower loss.

In a non-reciprocal circuit device according to a first aspect of various preferred embodiments of the present invention, a first center conductor, a second center conductor, and a third center conductor are disposed on a ferrite, to which a direct current magnetic field is applied by a permanent magnet, so as to be insulated from one another and so as to intersect with one another; one end of the first center conductor defines a first port, one end of the second center conductor defines a second port, and one end of the third center conductor defines a third port; the first port is connected to a first terminal, the second port is connected to a second terminal, and the third port is connected to a third terminal; the other ends of the first center conductor, the second center conductor, and the third center conductor are connected to one another, which is then connected to a ground; and a capacitance element is connected in parallel to each of the first center conductor, the second center conductor, and the third center conductor.

In a non-reciprocal circuit device according to a second aspect of various preferred embodiments of the present invention, a first center conductor, a second center conductor, and a third center conductor are disposed on a ferrite, to which a direct current magnetic field is applied by a permanent magnet, so as to be insulated from one another and so as to intersect with one another; one end of the first center conductor defines a first port, one end of the second center conductor defines a second port, and one end of the third center conductor defines a third port; the other ends of the first center conductor, the second center conductor, and the third center conductor are connected to one another, which is then connected to a ground via an inductance element and a capacitance element that are connected in series; a capacitance element is connected in parallel to each of the first center conductor, the second center conductor, and the third center conductor; and a capacitance element is connected at each location between the first port and the first terminal, between the second port and the second terminal, and between the third port and the third terminal.

In a non-reciprocal circuit device according to a third aspect of various preferred embodiments of the present invention, a first center conductor, a second center conductor, and a third center conductor are disposed on a ferrite, to which a direct current magnetic field is applied by a permanent magnet, so as to be insulated from one another and so as to intersect with one another; one end of the first center conductor defines a first port, one end of the second center conductor defines a second port, one end of the third center conductor defines a third port, and the third port is connected to a ground via a capacitance element and a resistance element that are connected in series; the other ends of the first center conductor, the second center conductor, and the third center conductor are connected to one another, which is then connected to a ground via an inductance element and a capacitance element that are connected in series; a capacitance element is connected in parallel to each of the first center conductor, the second center conductor, and the third center conductor; and a capacitance element is connected at each location between the first port and the first terminal and between the second port and the second terminal.

In addition, in each of the non-reciprocal circuit devices according to the first, second, and third aspects of various preferred embodiments of the present invention, an internal magnetic field and a saturation magnetization are set so as to satisfy the following expression.

$$\gamma(\mu_0 Hin + Ms) \leq \omega \qquad \text{Math. 1}$$

γ: gyromagnetic ratio

μ0: space permeability

Hin: internal magnetic field

Ms: saturation magnetization

ω: angular frequency

The non-reciprocal circuit devices described above are each of a lumped constant type, in which the first center conductor, the second center conductor, and the third center conductor are disposed on the ferrite, to which a direct current magnetic field is applied by the permanent magnet, so as to be insulated from one another and so as to intersect with one another. In the non-reciprocal circuit devices according to the first and second aspects of various preferred embodiments of the present invention, a high frequency signal inputted through the second port is outputted through the first port; a high frequency signal inputted through the first port is outputted through the third port; and a high frequency signal inputted through the third port is outputted through the second port. In the non-reciprocal circuit device according to the third aspect of various preferred embodiments of the present invention, a high frequency signal inputted through the second port is outputted through the first port. Meanwhile, a high frequency signal inputted through the first port is not outputted to the second port since the third port is terminated by the resistance element.

It is to be noted that the input and output relationship of high frequency signals is reversed by inverting the direct current magnetic field applied by the permanent magnet. In addition, a capacitance value or an inductance value of at least one of the capacitance elements and the inductance element may be variable.

As the internal magnetic field Hin and the saturation magnetization Ms of the ferrite satisfy the above expression, the non-reciprocal circuit device described above operates as a lumped constant type device in a low magnetic field while the magnetic permeability μ+' is in a positive region. Thus, the size of the magnetic circuit is greatly reduced, and the size of the ferrite is greatly reduced as well. In addition, the device operates at a position spaced apart from a magnetic resonant point, and thus a magnetic loss is significantly reduced or prevented.

According to various preferred embodiments of the present invention, lumped constant type non-reciprocal circuit devices that is significantly reduced in size and suffers a lower loss are achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
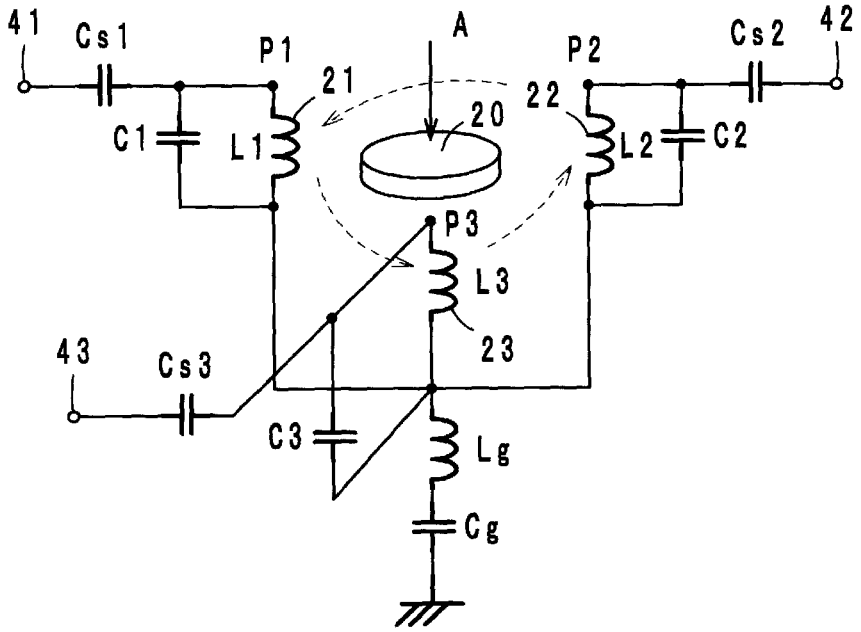
FIG. 1 is an equivalent circuit diagram illustrating a non-reciprocal circuit device (3-port type circulator) according to a first preferred embodiment of the present invention.

Hereinafter, preferred embodiments of a non-reciprocal circuit device according to the present invention will be described with reference to the accompanying drawings. It is to be noted that, in each of the drawings, identical components are given identical reference characters, and duplicate descriptions thereof will be omitted.

First Preferred Embodiment

A non-reciprocal circuit device according to a first preferred embodiment is a lumped constant type 3-port type circulator having an equivalent circuit illustrated in FIG. 1. Specifically, a first center conductor 21 (L1), a second center conductor 22 (L2), and a third center conductor 23 (L3) are disposed on a ferrite 20, to which a direct current magnetic field is applied by a permanent magnet in a direction indicated by an arrow A, so as to be insulated from one another and so as to intersect with one another at predetermined angles. One end of the first center conductor 21 defines a first port P1; one end of the second center conductor defines a second port P2; and one end of the third center conductor 23 defines a third port P3.

The other ends of the respective center conductors 21, 22, and 23 are connected to one another, which is then connected to a ground via an inductance element Lg and a capacitance element Cg that are connected in series. Capacitance elements C1, C2, and C3 are connected in parallel to the respective center conductors 21, 22, and 23. A capacitance element Cs1 is connected between the first port P1 and a first terminal 41; a capacitance element Cs2 is connected between the second port P2 and a second terminal 42; and a capacitance element Cs3 is connected between the third port P3 and a third terminal 43.

Figure 3:
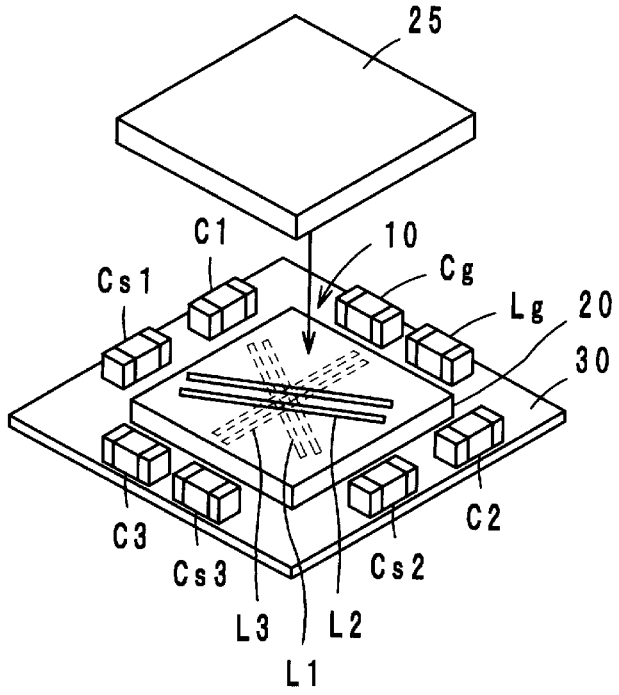
FIG. 3 is an exploded perspective view illustrating the non-reciprocal circuit device according to the first preferred embodiment of the present invention.
Figure 4:
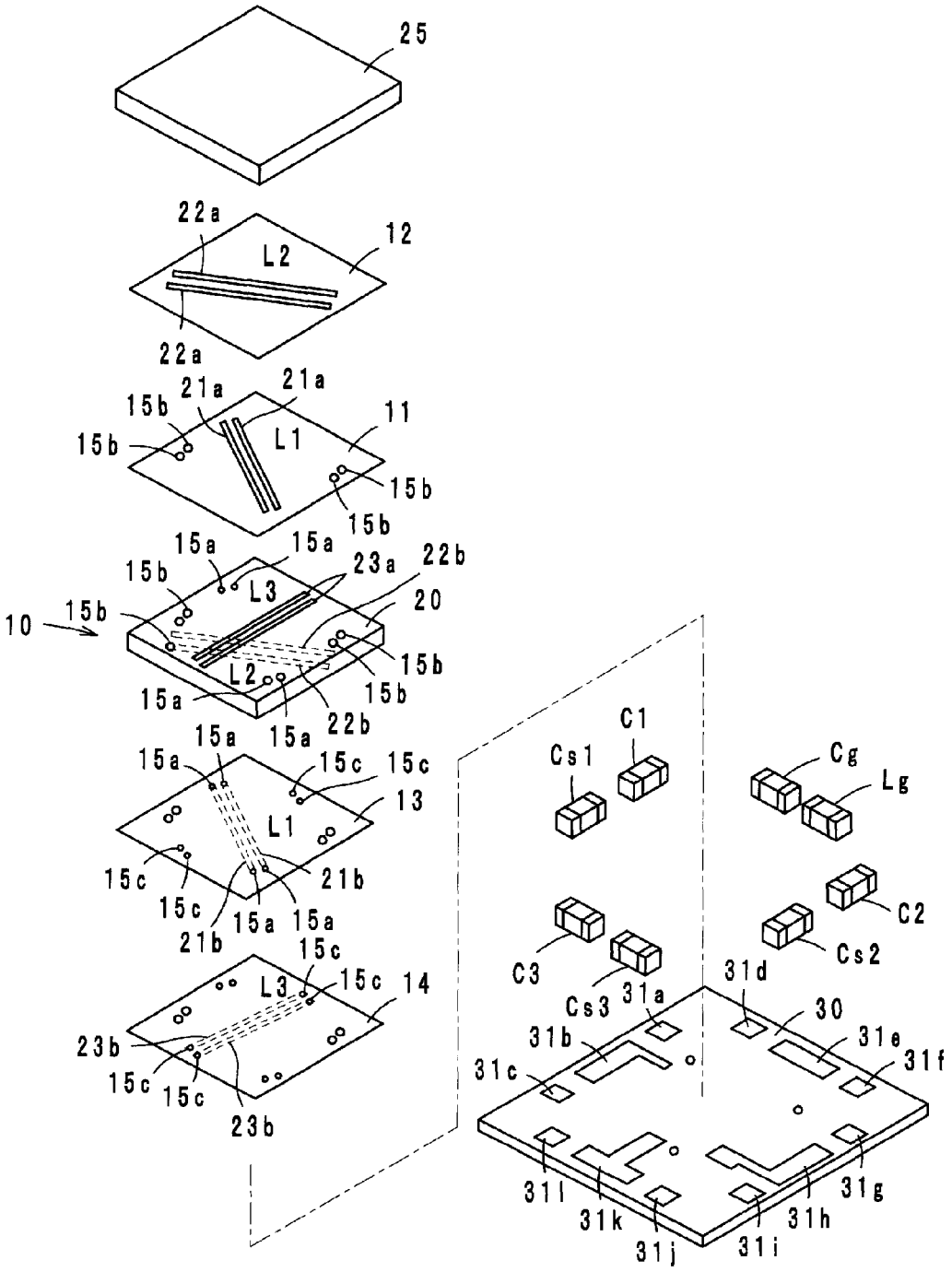
FIG. 4 is an exploded perspective view illustrating, in a more detailed manner, the non-reciprocal circuit device according to the first preferred embodiment of the present invention.

The 3-port type circulator having the equivalent circuit described above preferably includes a circuit board 30, a center conductor assembly 10, and a permanent magnet 25, as illustrated in FIG. 3 and FIG. 4.

The center conductor assembly 10 preferably includes insulator layers 11, 12, 13, and 14 stacked on upper and lower surfaces of the rectangular microwave ferrite 20. Conductors 21*a* defining the first center conductor 21 are provided on the upper surface of the insulator layer 11, and conductors 21*b* are provided on the lower surface of the insulator layer 13. Then, the conductors 21*a* are connected to the respective conductors 21*b* in a coil form by via hole conductors 15*a*. Conductors 22*a* defining the second center conductor 22 are provided on the upper surface of the insulator layer 12, and conductors 22*b* are provided on the lower surface of the ferrite 20. Then, the conductors 22*a* are connected to the respective conductors 22*b* in a coil form by via hole conductors 15*b*. Conductor 23*a* defining the third center conductor 23 are provided on the upper surface of the ferrite 20, and conductors 23*b* are provided on the lower surface of the insulator layer 14. Then, the conductors 23*a* are connected to the respective conductors 23*b* in a coil form by via hole conductors 15*c*.

The center conductors 21, 22, and 23 can each be defined by a thin film conductor, a thick film conductor, or a conductive foil on the ferrite 20, for example. In the present preferred embodiment, the center conductors 21, 22, and 23 are each preferably wound twice around the ferrite 20, but the number of turns is not limited thereto. Chip components are preferably used for various capacitance elements and inductance elements. For example, the ferrite 20 preferably is about 2.0 mm on each side and preferably has a thickness of about 0.15 mm, for example. Each of the center conductors 21, 22, and 23 preferably has a conductor width of about 0.06 mm to about 0.2 mm, for example. Photosensitive glass preferably is used for the insulator layers 11 through 14, and photosensitive metal paste preferably is used for the center conductors 21, 22, and 23, for example.

Electrodes 31*a* through 31*l* are provided on the upper surface of the circuit board 30 to mount end portions of the center conductors 21, 22, and 23 and various chip type capacitance elements and inductance elements. As illustrated in FIG. 3, the center conductor assembly 10 and the permanent magnet 25 are stacked and mounted on the circuit board 30, and thus the 3-port type circulator having the equivalent circuit illustrated in FIG. 1 is provided. In addition, although not illustrated, the first, second, and third terminals 41, 42, and 43 are provided on the lower surface of the circuit board 30.

In the 3-port type circulator according to the first preferred embodiment, a high frequency signal inputted through the second terminal 42 (second port P2) is outputted through the first terminal 41 (first port P1); a high frequency signal inputted through the first terminal 41 (first port P1) is outputted through the third terminal 43 (third port P3); and a high frequency signal inputted through the third terminal 43 (third port P3) is outputted through the second terminal 42 (second port P2).

Figure 2:
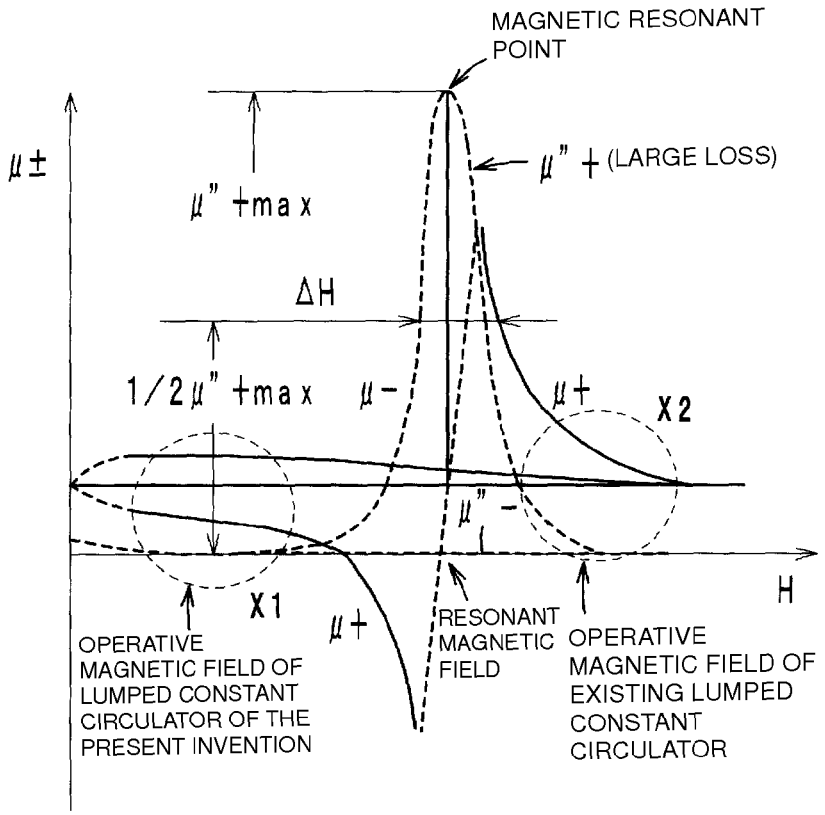
FIG. 2 is a graph illustrating magnetic permeability of a circularly polarized wave through a magnetic field of a ferrite.

Hereinafter, operating characteristics of the first preferred embodiment will be described with reference to FIG. 2. FIG. 2 illustrates magnetic permeability $\mu\pm$ of a magnetic field (A/m). In the present preferred embodiment, the 3-port type circulator is operated in a low magnetic field region X1 enclosed by a dotted line in FIG. 2. In other words, a weak direct current magnetic field is applied to the ferrite 20 so that the 3-port type circulator operates in a region where $\mu- > \mu+ > 0$ is fulfilled. In the meantime, in a high magnetic field region X2, a strong direct current magnetic field is applied to the ferrite 20 so that the 3-port type circulator operates in a region where $\mu+ > \mu-$ is fulfilled. The relationship between $\mu+$ and $\mu-$ is reversed in the low magnetic field region X1 and the high magnetic field region X2, and thus the flow of a high frequency signal is reversed if the direction in which the magnetic field is applied is identical. If the direction in which the magnetic field is applied is reversed, however, a transmission path of a high frequency signal switches. In other words, the insertion loss characteristics and the isolation characteristics are switched.

The magnetic permeability of a circularly polarized wave is expressed through the following expression (1).

Math. 2

$$\mu_{\pm} = 1 + \frac{\gamma Ms}{\mu_0 \gamma (Hin + j\Delta H/2) \pm \omega} \tag{1}$$

With the loss term being ignored, the strength of the magnetic field in FIG. 2 becomes $\mu+'>0$ at the magnetic resonant point or lower in the following expression (2), which is derived from the above expression (1).

Math. 3

$$\gamma(\mu_0 Hin+Ms)\leq\omega \quad (2)$$

γ: gyromagnetic ratio
μ0: space permeability
Hin: internal magnetic field
Ms: saturation magnetization
ω: angular frequency Thus, by setting the internal magnetic field Hin, the saturation magnetization Ms, and so forth so as to satisfy the expression (2) above, a lumped constant type isolator that operates in a low magnetic field can be realized. As the lumped constant type isolator operates in a low magnetic field, a magnetic field to be applied by the permanent magnet 25 can be kept small. Thus, the size of the magnet 25 is reduced, and the size of the magnetic circuit is reduced in turn. In other words, with this lumped constant type isolator, the size of the magnetic circuit is reduced, and the size of the ferrite 20 is reduced as well. In addition, the lumped constant type isolator operates at a position spaced apart from the magnetic resonant point, and thus a magnetic loss is reduced.

In an existing waveguide type isolator, the size of the ferrite needs to be λ/2. Meanwhile, in a lumped constant type isolator, a necessary inductance is provided, and thus the size of the ferrite is reduced to far less than about λ/2, or may even be about λ/4 or less, for example.

Figure 5:
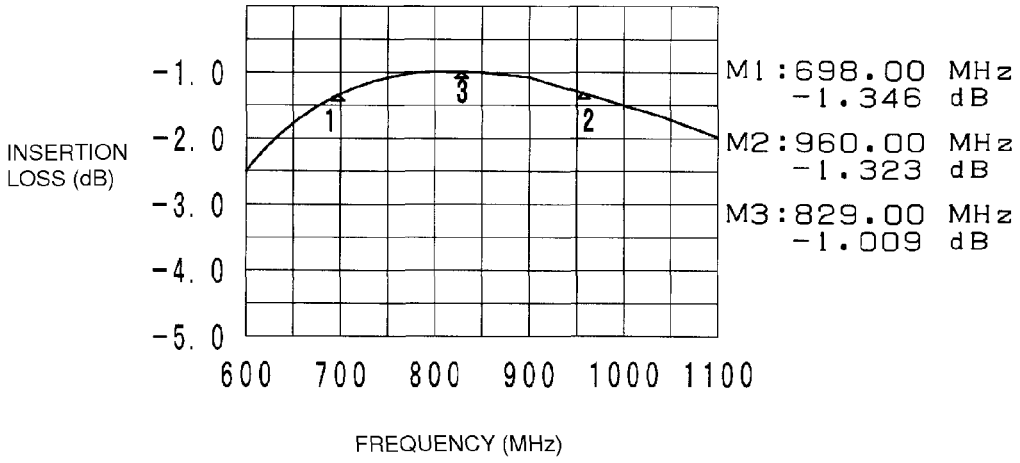
FIG. 5 is a graph illustrating the insertion loss characteristics of the non-reciprocal circuit device according to the first preferred embodiment of the present invention.
Figure 6:
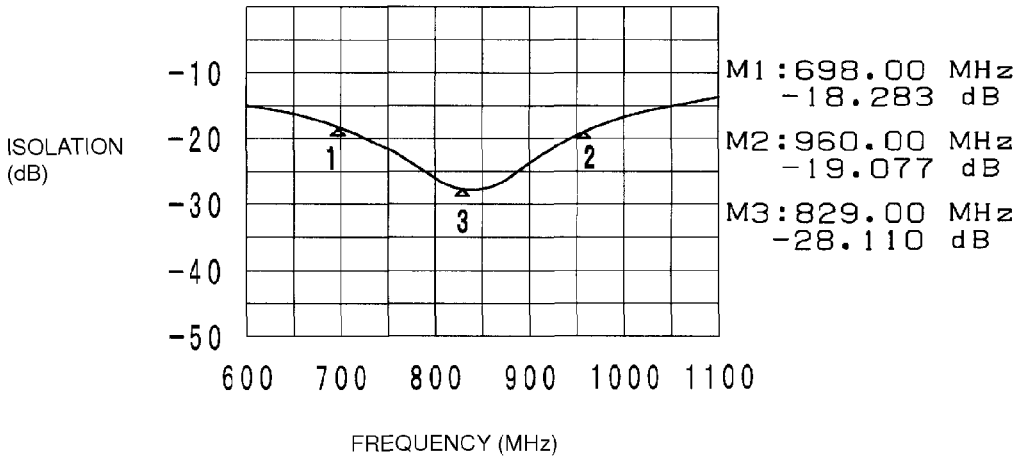
FIG. 6 is a graph illustrating the isolation characteristics of the non-reciprocal circuit device according to the first preferred embodiment of the present invention.

In the 3-port type circulator according to the first preferred embodiment, the insertion loss characteristics from the first terminal 41 to the third terminal 43 are illustrated in FIG. 5, and the isolation characteristics from the first terminal 41 to the second terminal 42 are illustrated in FIG. 6. The operating band width is approximately 30% (698 through 960 MHz), and broad band characteristics are obtained for a lumped constant type circulator, for example. In particular, the broad band characteristics are obtained since the capacitance elements Cs1, Cs2, and Cs3 are connected to the respective ports P1, P2, and P3 and the other ends of the respective center conductors 21, 22, and 23 are connected to the ground through the series resonant circuit defined by the inductance element Lg and the capacitance element Cg.

For example, the specifications of each of the elements held when the above characteristics are obtained are as follows:

capacitance element C1: 1.0 pF
capacitance element C2: 1.0 pF
capacitance element C3: 0.2 pF
capacitance element Cs1: 4.7 pF
capacitance element Cs2: 5.0 pF
capacitance element Cs3: 5.6 pF
capacitance element Cg: 9.0 pF
inductance element Lg: 1.5 nH In particular, the ferrite 20 is disposed so as to be parallel or substantially parallel to the upper surface of the circuit board 30 and is operated in a low magnetic field, which allows the necessary magnetic field to be applied to be kept small, and as a result, the thickness of the permanent magnet 25 is significantly reduced. In addition, a yoke can be omitted due to the low magnetic field, and the height of the circulator as a whole is thus significantly reduced.

Meanwhile, due to the low magnetic field operation (magnetic permeability of circularly polarized waves is less than 1), a configuration in which the center conductors 21, 22, and 23 are each wound around the ferrite 20 a plurality of number of turns (specifically, two turns) is preferably used in order to secure a necessary inductance value. In addition, the linear conductors 21*a*, 21*b*, 22*a*, 22*b*, 23*a*, and 23*b* provided on the respective layers define a coil with the via hole conductors, and thus the lengths (inductance values) of the respective center conductors 21, 22, and 23 are capable of being changed by changing the position of the via hole conductors. Furthermore, as the conductors 21*a*, 21*b*, 22*a*, 22*b*, 23*a*, and 23*b* are provided on separate layers, the center conductors 21, 22, and 23 preferably are disposed so as to be equally spaced apart from the ferrite 20, which allows the magnetic field to be applied equally to the center conductors 21, 22, and 23. It is to be noted that the insertion loss characteristics or the isolation characteristics are capable of being adjusted by changing the locations where the conductors 21*a*, 21*b*, 22*a*, 22*b*, 23*a*, and 23*b* are stacked.

Second Preferred Embodiment

Figure 7:
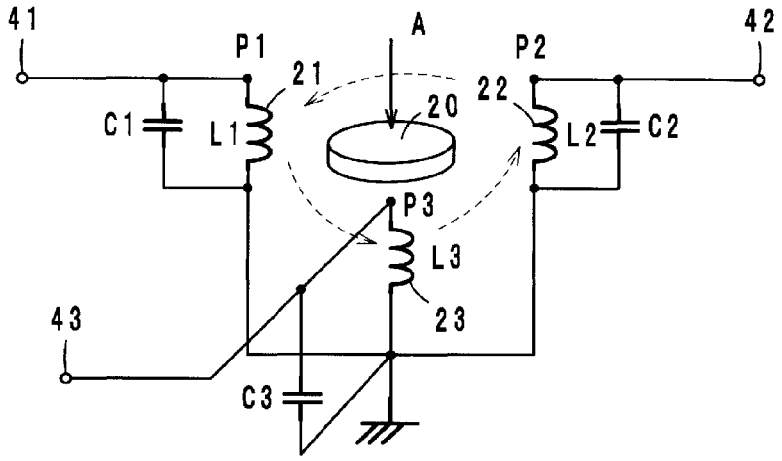
FIG. 7 is an equivalent circuit diagram illustrating a non-reciprocal circuit device (3-port type circulator) according to a second preferred embodiment of the present invention.

A non-reciprocal circuit device according to a second preferred embodiment of the present invention is a lumped constant type 3-port type circulator having an equivalent circuit illustrated in FIG. 7. Specifically, the first center conductor 21 (L1), the second center conductor 22 (L2), and the third center conductor 23 (L3) are disposed on the ferrite 20, to which a direct current magnetic field is applied by the permanent magnet in the direction indicated by the arrow A, so as to be insulated from one another and so as to intersect with one another at predetermined angles. One end of the first center conductor 21, defining the first port P1, is connected directly to the first terminal 41; one end of the second center conductor 22, defining the second port P2, is connected directly to the second terminal 42; and one end of the third center conductor 23, defining the third port P3, is connected directly to the third terminal 43. In addition, the other ends of the respective center conductors 21, 22, and 23 are connected to one another, which is then connected to the ground. The capacitance elements C1, C2, and C3 are connected in parallel to the respective center conductors 21, 22, and 23.

In other words, the second preferred embodiment differs in that the capacitance elements Cs1, Cs2, and Cs3, the inductance element Lg, and the capacitance element Cg are omitted from the circulator according to the first preferred embodiment described above. The center conductors 21, 22, and 23 preferably have the same configurations as those of the first preferred embodiment, and the 3-port type circulator has a configuration in which the aforementioned elements are removed from the configuration illustrated in FIG. 4. In addition, the internal magnetic field Hin and the saturation magnetization Ms are set so as to satisfy the above expression (2).

Figure 8:
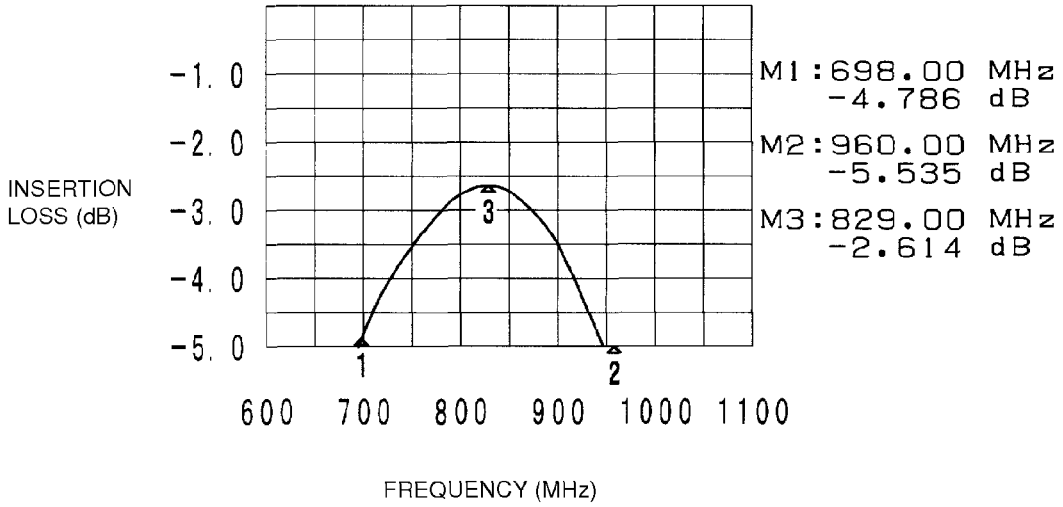
FIG. 8 is a graph illustrating the insertion loss characteristics of the non-reciprocal circuit device according to the second preferred embodiment of the present invention.
Figure 9:
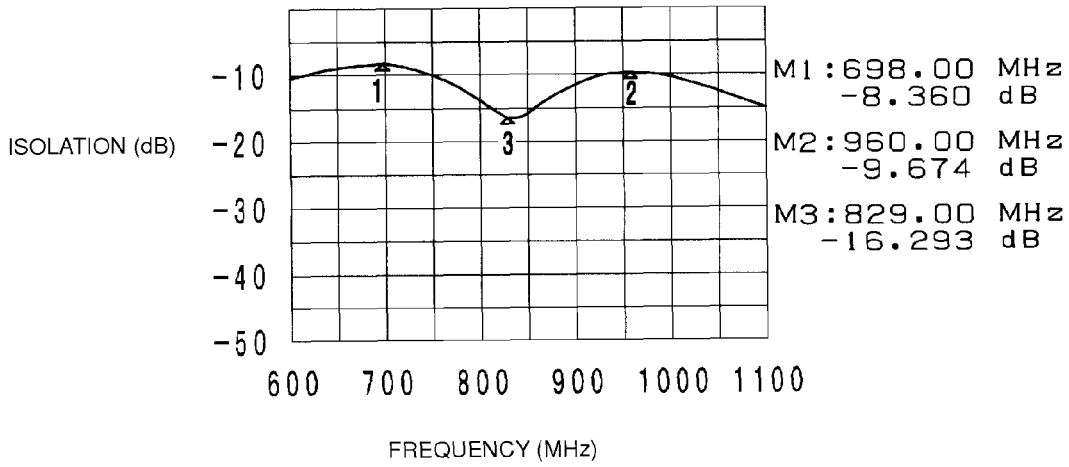
FIG. 9 is a graph illustrating the isolation characteristics of the non-reciprocal circuit device according to the second preferred embodiment of the present invention.

The operating mode in the second preferred embodiment is basically similar to that of the first preferred embodiment, and similar effects are obtained. The insertion loss characteristics from the first terminal 41 to the third terminal 43 are illustrated in FIG. 8, and the isolation characteristics from the first terminal 41 to the second terminal 42 are illustrated in FIG. 9.

Figure 10:
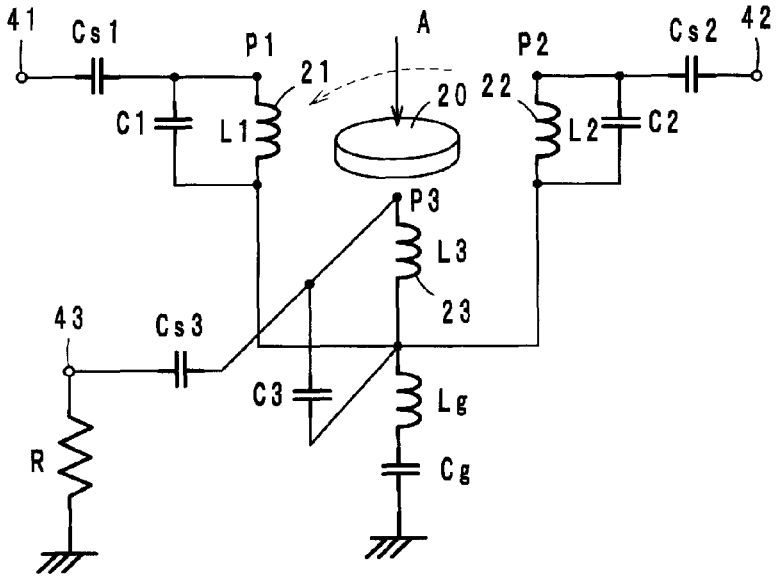
FIG. 10 is an equivalent circuit diagram illustrating a non-reciprocal circuit device (isolator) according to a third preferred embodiment.

For example, the specifications of each of the elements held when the above characteristics are obtained are as follows:

capacitance element C1: 11.0 pF
capacitance element C2: 11.0 pF
capacitance element C3: 12.0 pF Third Preferred Embodiment A non-reciprocal circuit device according to a third preferred embodiment preferably is a lumped constant type isolator having an equivalent circuit illustrated in FIG. 10. Specifically, the first center conductor 21 (L1), the second center conductor 22 (L2), and the third center conductor 23 (L3) are disposed on the ferrite 20, to which a direct current magnetic field is applied by the permanent magnet in the direction indicated by the arrow A, so as to be insulated from one another and so as to intersect with one another at predetermined angles. One end of the first center conductor 21 defines the first port P1; one end of the second center conductor defines the second port P2; and one end of the third center conductor 23 defines the third port P3.

In addition, the other ends of the respective center conductors 21, 22, and 23 are connected to one another, which is then connected to the ground via the inductance element Lg and the capacitance element Cg that are connected in series. The capacitance elements C1, C2, and C3 are connected in parallel to the respective center conductors 21, 22, and 23. The capacitance element Cs1 is connected between the first port P1 and the first terminal 41; the capacitance element Cs2 is connected between the second port P2 and the second terminal 42; and the capacitance element Cs3 is connected between the third port P1 and the third terminal 43. In addition, a resistance element R is connected in series to the capacitance element Cs3 via the third terminal 43, and the resistance element R is connected to the ground. In other words, the third port P3 is terminated by the resistance element R.

In the third preferred embodiment, the center conductors 21, 22, 23 preferably have the same configurations as those of the first preferred embodiment, and the configuration of the isolator is basically similar to the configuration illustrated in FIG. 4 except for the arrangement of the chip components. In addition, the internal magnetic field Hin and the saturation magnetization Ms are set so as to satisfy the above expression (2).

In the non-reciprocal circuit device according to the third preferred embodiment, a high frequency signal inputted through the second terminal 42 (second port) P2 is outputted through the first terminal 41 (first port P1). Meanwhile, a high frequency signal inputted through the first terminal 41 (first port P1) is not outputted to the second terminal (second port P2) since the third port P3 is terminated by the resistance element R.

Figure 11:
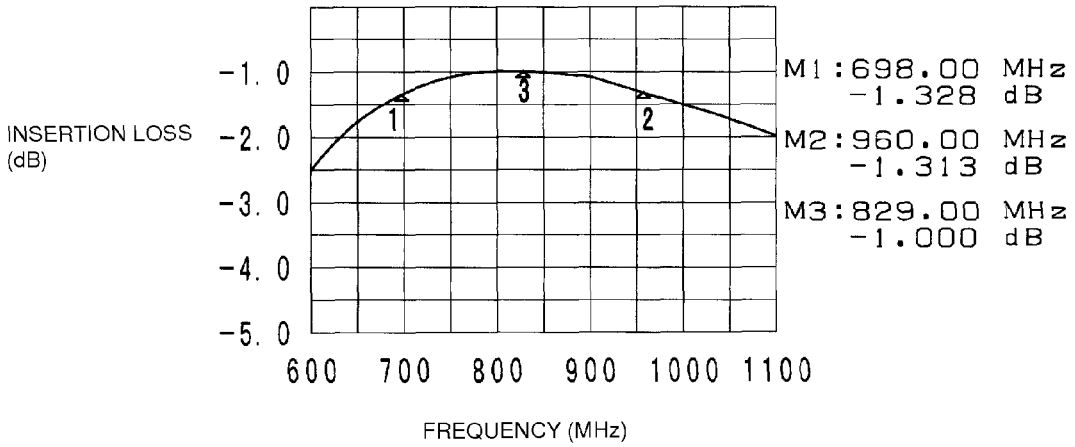
FIG. 11 is a graph illustrating the insertion loss characteristics of the non-reciprocal circuit device according to the third preferred embodiment of the present invention.
Figure 12:
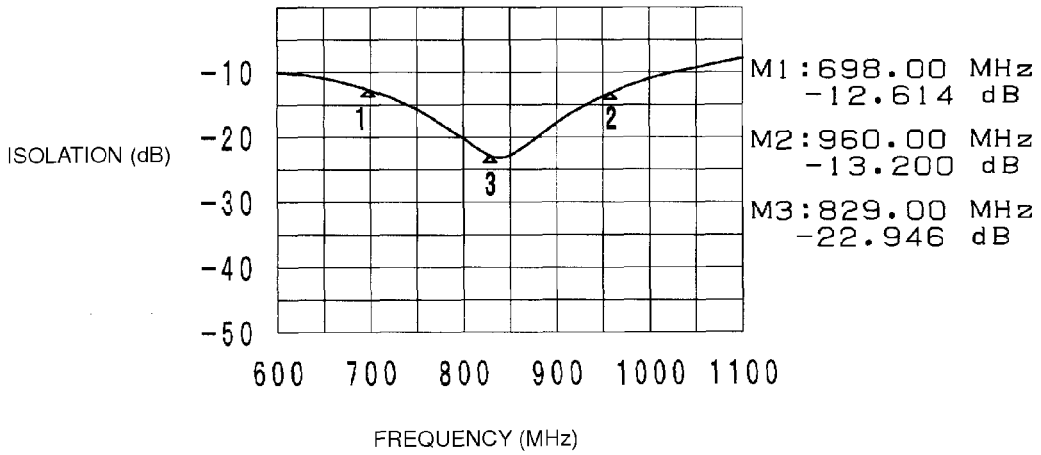
FIG. 12 is a graph illustrating the isolation characteristics of the non-reciprocal circuit device according to the third preferred embodiment of the present invention.

The insertion loss characteristics from the second terminal 42 to the first terminal 41 in the third preferred embodiment are illustrated in FIG. 11, and the isolation characteristics from the first terminal 41 to the second terminal 42 are illustrated in FIG. 12.

For example, the specifications of each of the elements held when the above characteristics are obtained are as follows:

capacitance element C1: 1.0 pF
capacitance element C2: 1.0 pF
capacitance element C3: 0.2 pF
capacitance element Cs1: 4.7 pF
capacitance element Cs2: 5.0 pF
capacitance element Cs3: 5.6 pF
capacitance element Cg: 9.0 pF
inductance element Lg: 1.5 nH
resistance element R: 50 Ω

Fourth Preferred Embodiment

Figure 13:
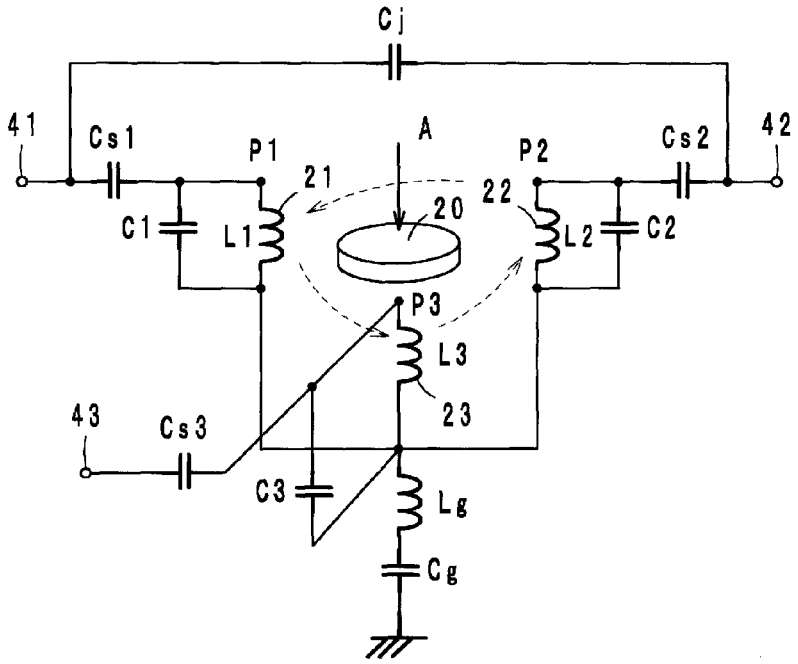
FIG. 13 is an equivalent circuit diagram illustrating a non-reciprocal circuit device (3-port type circulator) according to a fourth preferred embodiment of the present invention.

A non-reciprocal circuit device according to a fourth preferred embodiment of the present invention preferably is a lumped constant type 3-port type circulator having an equivalent circuit illustrated in FIG. 13. This circulator is obtained by connecting a capacitance element Cj between the first terminal 41 and the second terminal 42 in the circulator illustrated as the first preferred embodiment above, and the basic operation is similar to that of the first preferred embodiment.

Figure 14:
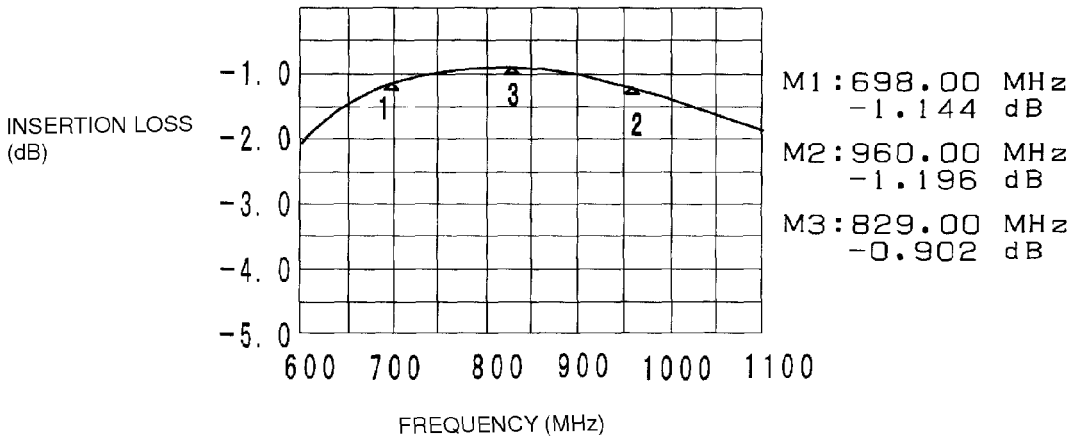
FIG. 14 is a graph illustrating the insertion loss characteristics of the non-reciprocal circuit device according to the fourth preferred embodiment of the present invention.
Figure 15:
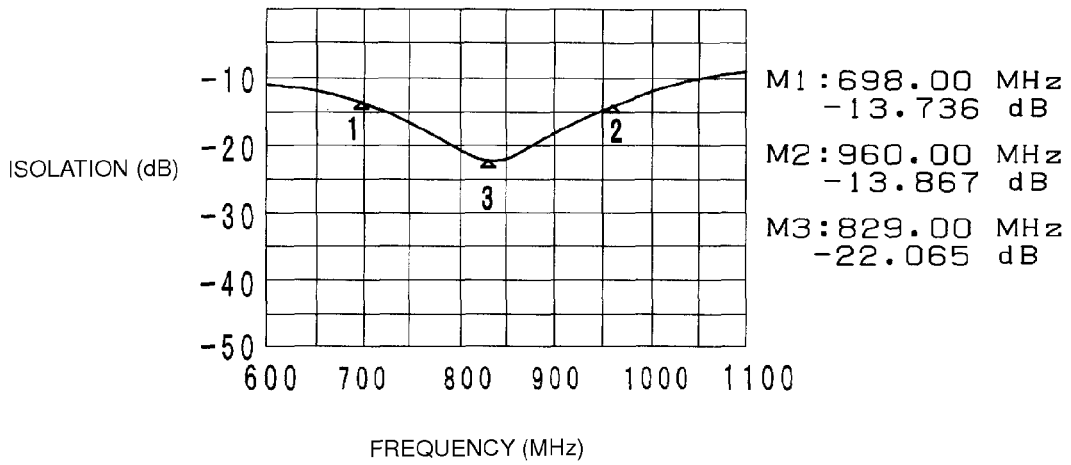
FIG. 15 is a graph illustrating the isolation characteristics of the non-reciprocal circuit device according to the fourth preferred embodiment of the present invention.

Because the capacitance element Cj is added, the insertion loss characteristics from the first terminal 41 to the third terminal 43 improve as compared to the characteristics illustrated in FIG. 5, as illustrated in FIG. 14. However, the isolation characteristics from the first terminal 41 to the second terminal 42 somewhat deteriorate as compared to the characteristics illustrated in FIG. 6, as illustrated in FIG. 15. Although there is such a trade-off between the insertion loss characteristics and the isolation characteristics obtained because the capacitance element Cj is added, an improvement in the insertion loss characteristics is important, and the above-described circulator is effective in a case in which there is leeway in the isolation characteristics.

Figure 16:
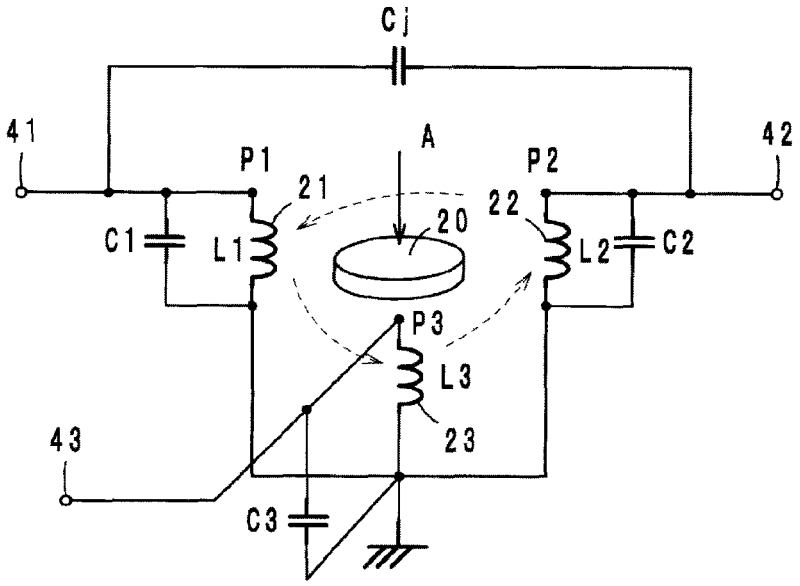
FIG. 16 is an equivalent circuit diagram illustrating a non-reciprocal circuit device (3-port type circulator) according to a fifth preferred embodiment of the present invention.

For example, the specifications of each of the elements held when the above characteristics are obtained are as follows:

capacitance element C1: 0.8 pF
capacitance element C2: 0.7 pF
capacitance element C3: 0.2 pF
capacitance element Cs1: 5.8 pF
capacitance element Cs2: 6.0 pF
capacitance element Cs3: 7.0 pF
capacitance element Cg: 9.0 pF
inductance element Lg: 1.5 nH
capacitance element Cj: 0.5 pF Fifth Preferred Embodiment A non-reciprocal circuit device according to a fifth preferred embodiment of the present invention is a lumped constant type 3-port type circulator having an equivalent circuit illustrated in FIG. 16. This circulator is obtained by connecting the capacitance element Cj between the first terminal 41 and the second terminal 42 in the circulator illustrated as the second preferred embodiment above, and the basic operation is similar to that of the second preferred embodiment. The effect obtained by adding the capacitance element Cj is similar to that of the fourth preferred embodiment described above, and the insertion loss characteristics improve.

Sixth Preferred Embodiment

Figure 17:
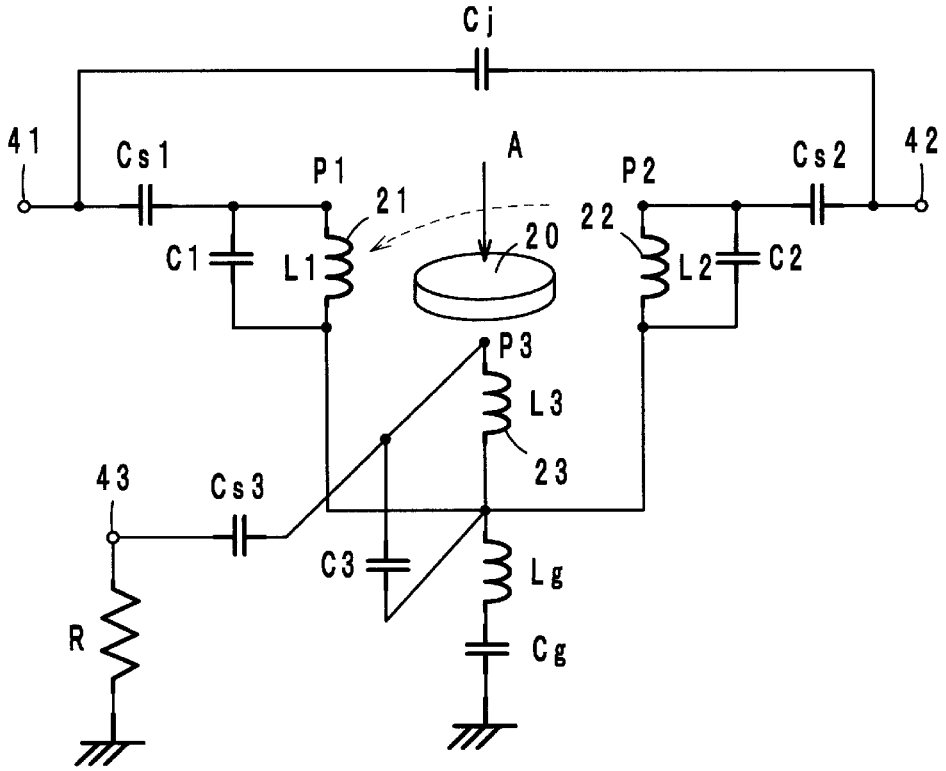
FIG. 17 is an equivalent circuit diagram illustrating a non-reciprocal circuit device (isolator) according to a sixth preferred embodiment of the present invention.

A non-reciprocal circuit device according to a sixth preferred embodiment of the present invention preferably is a lumped constant type isolator having an equivalent circuit illustrated in FIG. 17. This isolator is obtained by connecting the capacitance element Cj between the first terminal 41 and the second terminal 42 in the isolator illustrated as the third preferred embodiment above, and the basic operation is similar to that of the third preferred embodiment. The effect obtained by adding the capacitance element Cj is similar to that of the fourth preferred embodiment described above, and the insertion loss characteristics improve.

Seventh Preferred Embodiment

Figure 18:
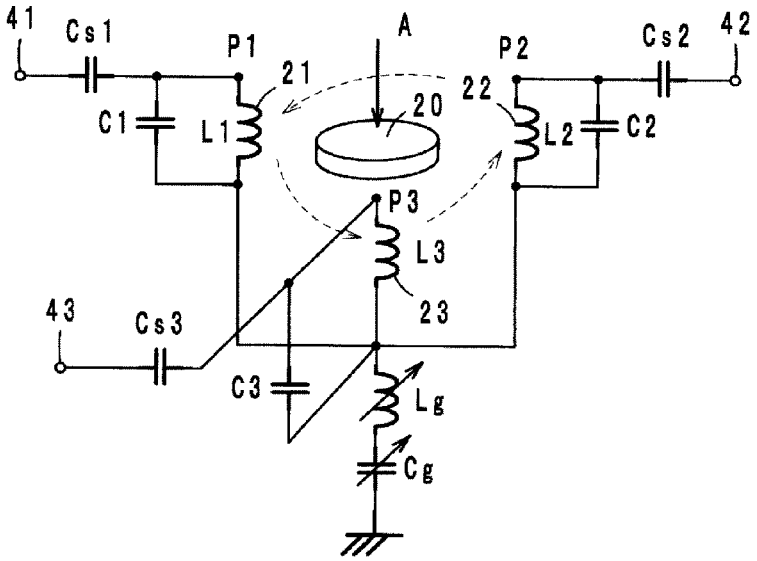
FIG. 18 is an equivalent circuit diagram illustrating a non-reciprocal circuit device (3-port type circulator) according to a seventh preferred embodiment of the present invention.

As illustrated in FIG. 18, a non-reciprocal circuit device according to a seventh preferred embodiment of the present invention preferably is obtained by making the capacitance value of the capacitance element Cg variable and making the inductance value of the inductance element Lg variable in the isolator illustrated as the first preferred embodiment above. Thus, the basic operation in the seventh preferred embodiment is similar to that of the first preferred embodiment, and similar effects are obtained. In addition, in the seventh preferred embodiment, as the capacitance value of the capacitance element Cg is made variable and the inductance value of the inductance element Lg is made variable, the characteristics are made to fit to a desired frequency band.

Figure 19:
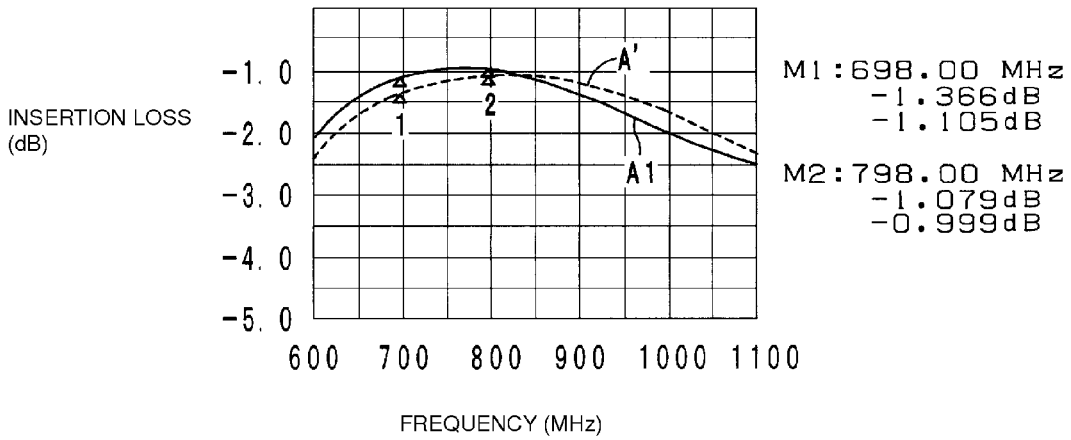
FIG. 19 is a graph illustrating the insertion loss characteristics of the non-reciprocal circuit device with first specifications according to the seventh preferred embodiment of the present invention.
Figure 20:
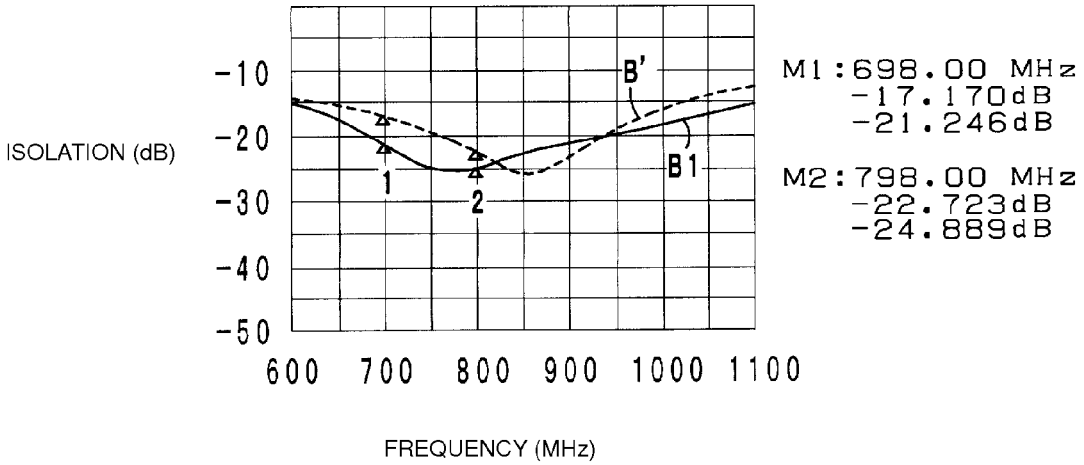
FIG. 20 is a graph illustrating the isolation characteristics of the non-reciprocal circuit device with the first specifications according to the seventh preferred embodiment of the present invention.

Here, in the seventh preferred embodiment, the insertion loss characteristics and the isolation characteristics obtained when the elements are modified to have first specifications indicated below are illustrated, respectively, by a curve A1 in FIG. 19 and a curve B1 in FIG. 20. It is to be noted that a curve A' and a curve B' in FIG. 19 and FIG. 20 illustrate the characteristics in the first preferred embodiment for reference. In the first specifications, the operation band frequency is preferably set to about 698 MHz to about 798 MHz.

Figure 21:
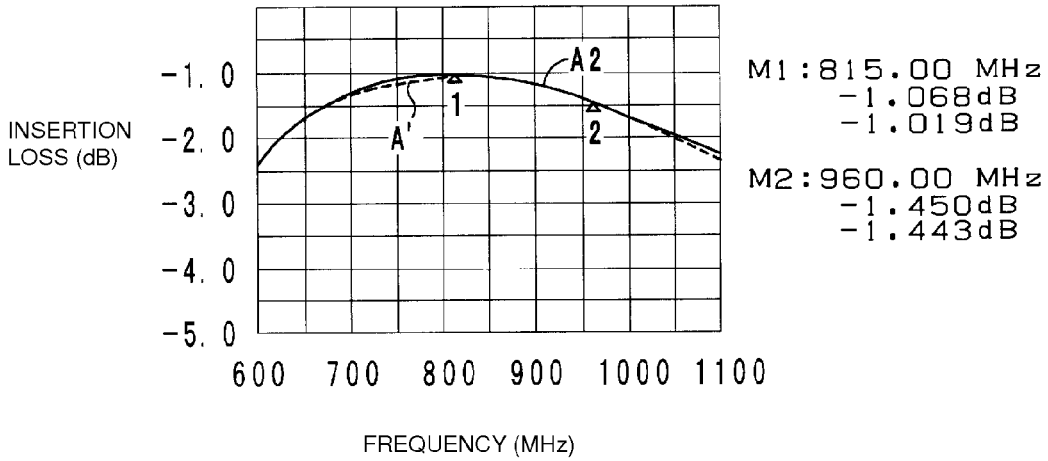
FIG. 21 is a graph illustrating the insertion loss characteristics of the non-reciprocal circuit device with second specifications according to the seventh preferred embodiment of the present invention.
Figure 22:
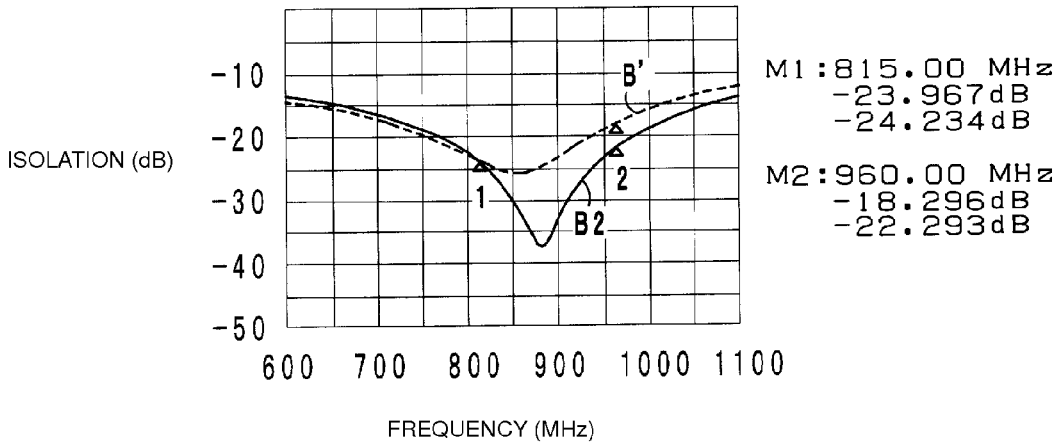
FIG. 22 is a graph illustrating the isolation characteristics of the non-reciprocal circuit device with the second specifications according to the seventh preferred embodiment of the present invention.

For example, the first specifications are as follows:

capacitance element C1: 1.0 pF
capacitance element C2: 1.0 pF
capacitance element C3: 0.2 pF
capacitance element Cs1: 4.7 pF
capacitance element Cs2: 5.0 pF
capacitance element Cs3: 5.6 pF
capacitance element Cg: 7.0 pF
inductance element Lg: 1.0 nH In addition, in the seventh preferred embodiment, the insertion loss characteristics and the isolation characteristics obtained when the elements are modified to have second specifications indicated below are illustrated, respectively, by a curve A2 in FIG. 21 and a curve B2 in FIG. 22. It is to be noted that the curve A' and the curve B' in FIG. 21 and FIG. 22 illustrate the characteristics in the first preferred embodiment for reference. In the second specifications, the operation band frequency is preferably set to about 815 MHz to about 960 MHz, for example.

For example, the second specifications are as follows:

capacitance element C1: 1.0 pF
capacitance element C2: 1.0 pF
capacitance element C3: 0.2 pF
capacitance element Cs1: 4.7 pF
capacitance element Cs2: 5.0 pF
capacitance element Cs3: 5.6 pF
capacitance element Cg: 9.0 pF
inductance element Lg: 1.0 nH

Eighth Preferred Embodiment

Figure 23:
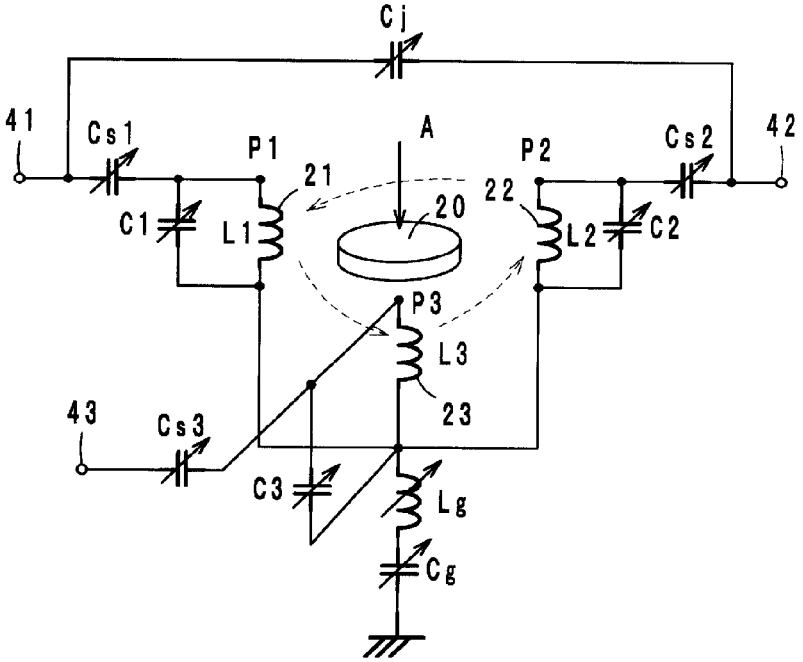
FIG. 23 is an equivalent circuit diagram illustrating a non-reciprocal circuit device (3-port type circulator) according to an eighth preferred embodiment of the present invention.

As illustrated in FIG. 23, a non-reciprocal circuit device according to an eighth preferred embodiment of the present invention preferably is obtained by making the capacitance value of all of the capacitance elements variable and making the inductance value of the inductance element variable in the isolator illustrated as the fourth preferred embodiment above. Thus, the basic operation in the eighth preferred embodiment is similar to that of the fourth preferred embodiment, and similar effects are obtained. In addition, in the eighth preferred embodiment, the center conductors 21, 22, and 23 are each wound around the ferrite 20 three times. Furthermore, as the capacitance value of each of the capacitance elements is made variable and the inductance value of the inductance element Lg is made variable, the characteristics are made to fit to a desired frequency band.

Figure 24:
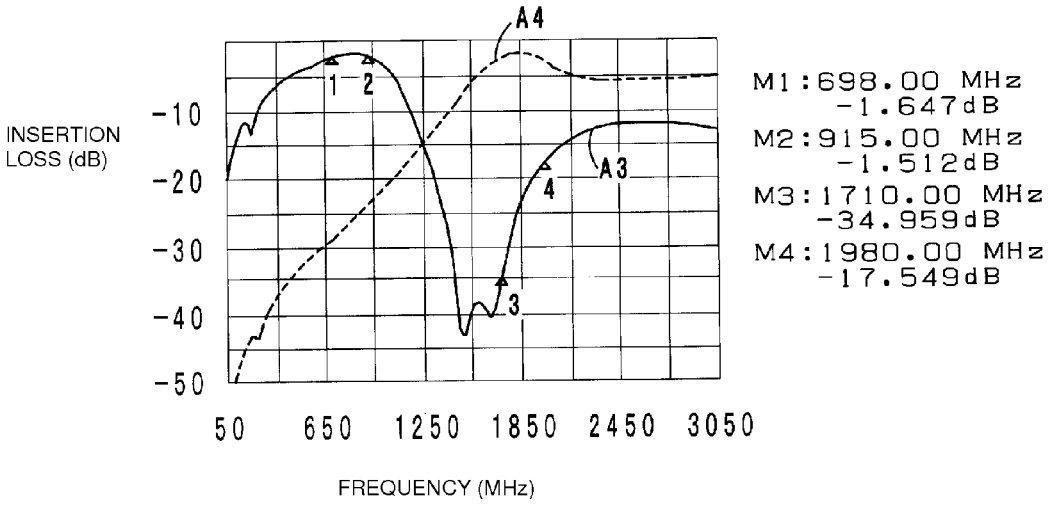
FIG. 24 is a graph illustrating the insertion loss characteristics of the non-reciprocal circuit device with first specifications according to the eighth preferred embodiment of the present invention.
Figure 25:
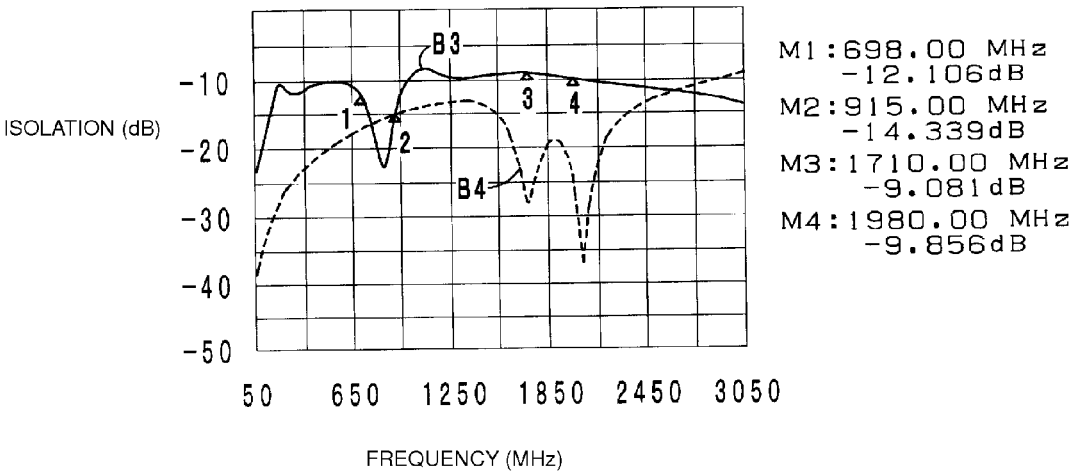
FIG. 25 is a graph illustrating the isolation characteristics of the non-reciprocal circuit device with the first specifications according to the eighth preferred embodiment of the present invention.

Here, in the eighth preferred embodiment, the insertion loss characteristics and the isolation characteristics obtained when the elements are modified to have first specifications indicated below are illustrated, respectively, by a curve A3 in FIG. 24 and a curve B3 in FIG. 25. It is to be noted that a curve A4 and a curve B4 in FIG. 24 and FIG. 25 illustrate the characteristics obtained with second specifications indicated below in the eighth preferred embodiment for reference. In the first specifications, the operation band frequency preferably is set to about 698 MHz to about 915 MHz, for example.

Figure 26:
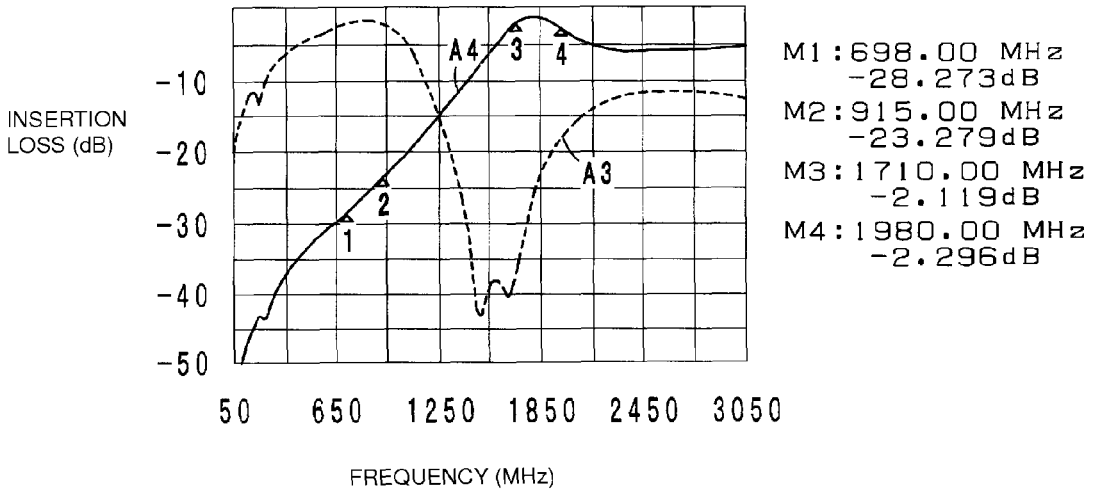
FIG. 26 is a graph illustrating the insertion loss characteristics of the non-reciprocal circuit device with second specifications according to the eighth preferred embodiment of the present invention.
Figure 27:
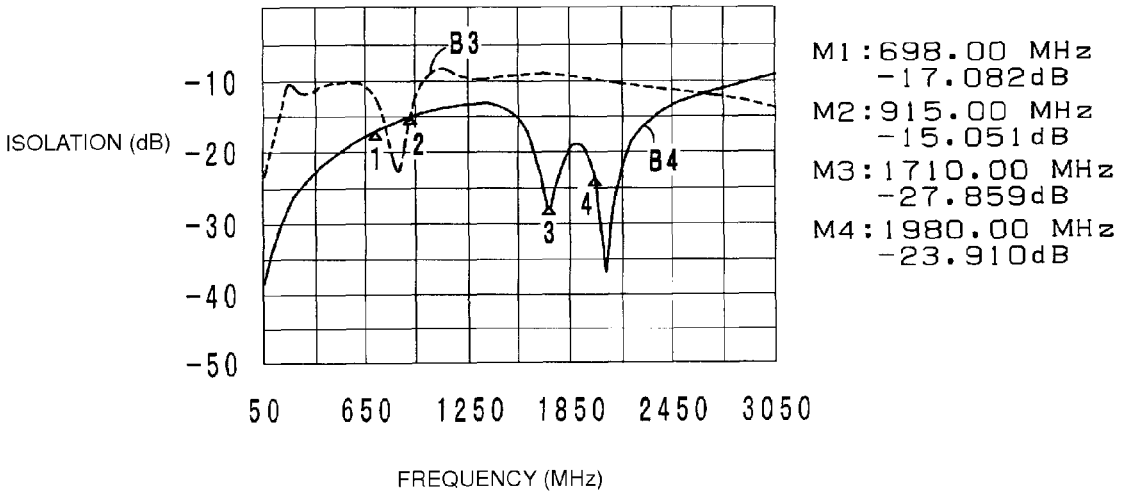
FIG. 27 is a graph illustrating the isolation characteristics of the non-reciprocal circuit device with the second specifications according to the eighth preferred embodiment of the present invention.

For example, the first specifications are as follows:

capacitance element C1: 5.8 pF
capacitance element C2: 5.8 pF
capacitance element C3: 1.5 pF
capacitance element Cs1: 9.2 pF
capacitance element Cs2: 5.8 pF
capacitance element Cs3: 10.0 pF
capacitance element Cg: 4.8 pF
inductance element Lg: 0.6 nH
capacitance element Cj: 0.0 pF In addition, in the eighth preferred embodiment, the insertion loss characteristics and the isolation characteristics obtained when the elements are modified to have the second specifications indicated below are illustrated, respectively, by the curve A4 in FIG. 26 and the curve B4 in FIG. 27. It is to be noted that the curve A3 and the curve B3 in FIG. 26 and FIG. 27 illustrate the characteristics illustrated in FIG. 24 and FIG. 25 for reference. In the second specifications, the operation band frequency is preferably set to about 1710 MHz to about 1980 MHz, for example.

For example, the second specifications are as follows:

capacitance element C1: 0.8 pF
capacitance element C2: 0.6 pF
capacitance element C3: 0.0 pF
capacitance element Cs1: 0.8 pF
capacitance element Cs2: 0.8 pF
capacitance element Cs3: 1.4 pF
capacitance element Cg: 4.8 pF
inductance element Lg: 0.6 nH
capacitance element Cj: 0.3 pF The capacitance values of the various capacitance elements and the inductance value of the inductance element can be switched, for example, by using a switching element including a node with the plurality of capacitance elements and the inductance element or by using a semiconductor switch (SPST switch, SPDT switch, MEMS switch, etc.).

Other Preferred Embodiments

It is to be noted that the non-reciprocal circuit device according to the present invention is not limited to the preferred embodiments described above, and various modifications can be made within the scope of the present invention.

For example, the configurations, the shapes, and so forth of the center conductors can be set as desired. In addition, instead of mounting the inductance element and the capacitance elements on a circuit board in the form of chip type elements, the inductance element and the capacitance elements may be constituted by conductors embedded in a circuit board.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A non-reciprocal circuit device, comprising:

a ferrite;

a first center conductor, a second center conductor, and a third center conductor disposed on the ferrite, to which a direct current magnetic field is applied by a permanent magnet, so as to be insulated from one another and so as to intersect with one another;

a first end of the first center conductor defines a first port, a first end of the second center conductor defines a second port, and a first end of the third center conductor defines a third port;

the first port is connected to a first terminal, the second port is connected to a second terminal, and the third port is connected to a third terminal;

second ends of the first center conductor, the second center conductor, and the third center conductor are connected to one another, and connected to a ground; and a capacitance element is connected in parallel to each of the first center conductor, the second center conductor, and the third center conductor; wherein the non-reciprocal circuit device is a lumped constant non-reciprocal circuit device; and an internal magnetic field and a saturation magnetization of the non-reciprocal circuit device satisfy the following expression:

$$\gamma(\mu_0 Hin+Ms)\leq\omega$$

γ: gyromagnetic ratio

μ0: space permeability

Hin: internal magnetic field

Ms: saturation magnetization

ω: angular frequency.

2. The non-reciprocal circuit device according to claim 1, wherein a capacitance value of at least one of the capacitance elements is variable.

3. The non-reciprocal circuit device according to claim 1, wherein the first center conductor, the second center conductor, and the third center conductor are each disposed linearly on the ferrite and insulator layers and are connected to define a coil including via hole conductors provided in the ferrite and the insulator layers.

4. The non-reciprocal circuit device according to claim 1, wherein the ferrite and the permanent magnet are stacked and disposed on a circuit board.

5. The non-reciprocal circuit device according to claim 1, wherein a size of the ferrite is about λ/4 or less, where λ is a frequency of the non-reciprocal device.

6. The non-reciprocal circuit device according to claim 1, wherein a capacitance element is connected between the first terminal and the second terminal.

7. The non-reciprocal circuit device according to claim 6, wherein a capacitance value of the capacitance element that is connected between the first terminal and the second terminal is variable.

8. A non-reciprocal circuit device, comprising:

a ferrite;

a first center conductor, a second center conductor, and a third center conductor disposed on the ferrite, to which a direct current magnetic field is applied by a permanent magnet, so as to be insulated from one another and so as to intersect with one another;

a first end of the first center conductor defines a first port, a first end of the second center conductor defines a second port, and a first end of the third center conductor defines a third port;

the first port is connected to a first terminal, the second port is connected to a second terminal, and the third port is connected to a third terminal;

second ends of the first center conductor, the second center conductor, and the third center conductor are connected to one another, and connected to a ground via an inductance element and a capacitance element that are connected in series;

a capacitance element is connected in parallel to each of the first center conductor, the second center conductor, and the third center conductor; and a capacitance element is connected at each location between the first port and the first terminal, between the second port and the second terminal, and between the third port and the third terminal; wherein the non-reciprocal circuit device is a lumped constant non-reciprocal circuit device; and an internal magnetic field and a saturation magnetization of the non-reciprocal circuit device satisfy the following expression:

$$\gamma(\mu_0 Hin+Ms)\leq\omega$$

γ: gyromagnetic ratio

μ0: space permeability

Hin: internal magnetic field

Ms: saturation magnetization

ω: angular frequency.

9. The non-reciprocal circuit device according to claim 8, wherein a capacitance value or an inductance value of at least one of the capacitance elements and the inductance element is variable.

10. The non-reciprocal circuit device according to claim 8, wherein the first center conductor, the second center conductor, and the third center conductor are each disposed linearly on the ferrite and insulator layers and are connected to define a coil including via hole conductors provided in the ferrite and the insulator layers.

11. The non-reciprocal circuit device according to claim 8, wherein the ferrite and the permanent magnet are stacked and disposed on a circuit board.

12. The non-reciprocal circuit device according to claim 8, wherein a size of the ferrite is about λ/4 or less, where λ is a frequency of the non-reciprocal device.

13. The non-reciprocal circuit device according to claim 8, wherein a capacitance element is connected between the first terminal and the second terminal.

14. The non-reciprocal circuit device according to claim 13, wherein a capacitance value of the capacitance element that is connected between the first terminal and the second terminal is variable.

* * * * *